US005980216A

United States Patent [19]

Tokumasu

[11] Patent Number: 5,980,216

[45] Date of Patent: Nov. 9, 1999

[54] VARIABLE CAPACITY SWASH PLATE COMPRESSOR HAVING A RETAINER SUPPORT PLATE

[75] Inventor: Hiroshi Tokumasu, Higashimatsuyama, Japan

[73] Assignee: Zexel Corporation, Tokyo, Japan

[21] Appl. No.: 08/987,707

[22] Filed: Dec. 9, 1997

[30] Foreign Application Priority Data

Dec. 13, 1996 [JP] Japan ..... 8-352990

[51] Int. Cl.[6] ..... F04B 1/26

[52] U.S. Cl. ..... 417/222.2; 92/12.2; 92/71

[58] Field of Search ..... 417/222.1, 222.2, 417/269; 92/71, 12.2, 57

[56] References Cited

U.S. PATENT DOCUMENTS 3,631,764 1/1972 Lucien ..... 417/222.1

5,762,477 6/1998 Jepson et al. ..... 417/269

5,868,061 2/1999 Hanson et al. ..... 92/71

*Primary Examiner*—Charles G. Freay

*Attorney, Agent, or Firm*—Frishauf, Holtz, Goodman, Langer & Chick, P.C.

[57] ABSTRACT

There is provided a variable capacity swash plate compressor having a construction which is capable of lubricating sliding contact portions of a retainer and a retainer support plate to thereby reduce abrasion of the two component parts of the compressor and prevent noises from being produced from them. The variable capacity swash plate compressor has a retainer mounted on its swash plate in a relatively rotatable manner with respect to the swash plate for supporting a plurality of shoes, and an annular retainer support plate for supporting the retainer in a state held in surface contact with one face of the retainer. In the variable capacity swash plate compressor, the retainer support plate is formed with a cut-away portion which is cut away therefrom, thereby increasing an exposed area of the one face of the retainer.

6 Claims, 7 Drawing Sheets

*FIG.8A* *FIG.8B*
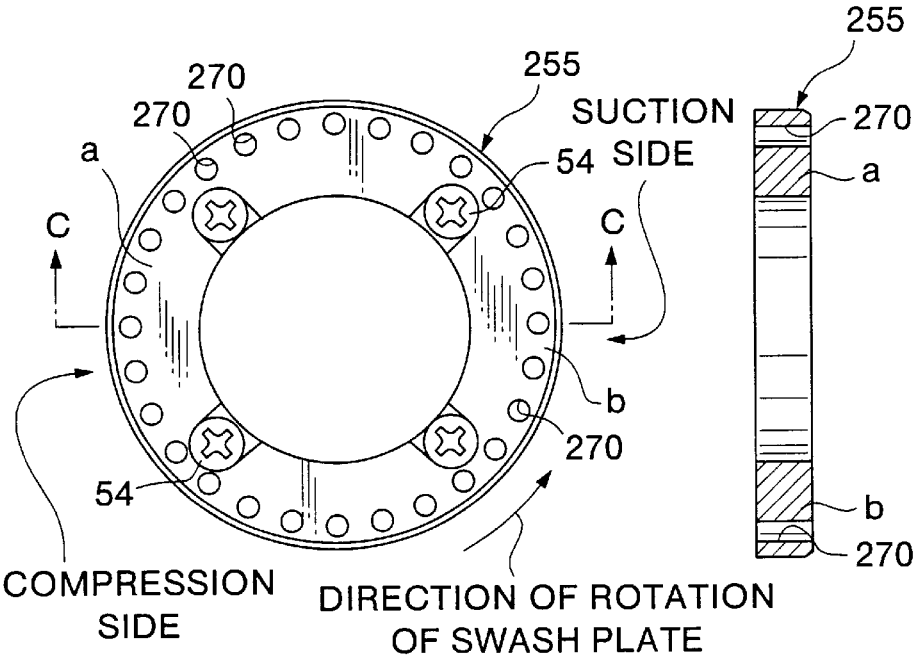
*FIG.9A* *FIG.9B*
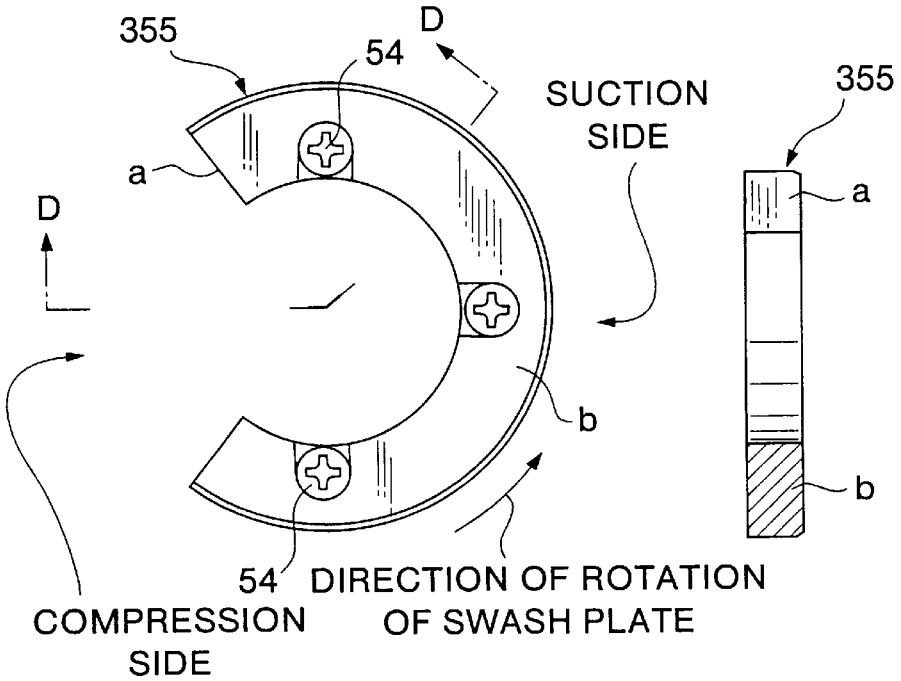

VARIABLE CAPACITY SWASH PLATE COMPRESSOR HAVING A RETAINER SUPPORT PLATE

BACKGROUND OF THE INVENTION

1. Field of the Invention

This invention relates to a variable capacity swash plate compressor, and more particularly to a variable capacity swash plate compressor having a construction which is improved in slidability between a retainer of shoes and a retainer support plate supporting the retainer.

2. Description of the Prior Art

FIG. 1 shows the whole arrangement of a conventional variable capacity swash plate compressor.

The conventional variable capacity swash plate compressor includes a drive shaft 105, a thrust flange 140 fixedly fitted on the drive shaft 105, for rotation in unison with the drive shaft 105, a swash plate 110 which is tiltably and rotatably mounted on the drive shaft 105 via a hinge ball 109, for rotation in unison with the thrust flange 140, a plurality of pistons 107 slidably received in respective cylinder bores 106, a plurality of shoes 150 arranged on a sliding surface 110*a* of the swash plate 110, for relative rotation with respect to the swash plate 110 according to the rotation of the drive shaft 105, a retainer 153 retaining the shoes 150, and a plurality of connecting rods 111.

Each connecting rod 111 has one end portion 111*a*, spherical in shape, slidably held in the shoe 150, for relative rotation with respect to the shoe 150, and the other end portion 111*b* secured to the piston 107.

FIG. 2 shows a view of the swash plate 110 taken from a rear side of the compressor.

The retainer 153 has its outer peripheral portion formed with a plurality of broken semi-annular portions 160 along its circumference through each of which a protruding portion 150*a* of each shoe 150 protrudes toward the piston 107. The retainer 153 is supported or held by a retainer support plate 155 which is fixed to a boss 110*b* of the swash plate 110 by bolts 154, such that the retainer 153 can perform relative rotation with respect to the swash plate 110.

Torque of an engine, not shown, installed on an automotive vehicle, not shown, is transmitted to the drive shaft 105. Torque of the drive shaft 105 is transmitted from the thrust flange 140 to the swash plate 110 via a linkage 141 to cause rotation of the swash plate 110.

The shoe 150 performs relative rotation on the sliding surface 110*a* of the swash plate 110 with respect to the swash plate 110, whereby torque transmitted from the swash plate 110 is converted into reciprocation of the piston 107. As the piston 107 reciprocates within the cylinder bore 106, the volume of a compression chamber within the cylinder bore 106 changes, whereby suction, compression and delivery of refrigerant gas are carried out sequentially. The inclination of the swash plate 110 changes with pressure within a crank case 108 in which the swash plate 110 is received, so that high-pressure refrigerant gas is discharged in an amount or volume corresponding to an inclination of the swash plate 110.

The retainer 153 performs relative rotation (or sliding) with respect to the swash plate 110 while receiving tensile forces of pistons 107 in the suction stroke for drawing refrigerant gas into compression chambers, which acts on corresponding portions of one face 153*a* (inner surface) of the retainer 153. The retainer support plate 155 supports or holds the retainer 153 in a state held in surface contact with a whole central portion of the one face 153*a* of the retainer 153. Therefore, the conventional variable capacity swash plate compressor suffers from the inconvenience that when conditions of lubrication get worse, abrasion occurs between sliding contact portions of the retainer 153 and the retainer support plate 155, and untoward noises are generated.

SUMMARY OF THE INVENTION

It is an object of the invention to provide a variable capacity swash plate compressor having a construction which is capable of reducing abrasion of a retainer and a retainer support plate of the compressor and at the same time preventing noises from being produced by sliding contact of the retainer and the retainer support plate.

To attain the above object, the present invention provides a variable capacity swash plate compressor including a drive shaft, a rotary member fixedly fitted on the drive shaft, for rotation in unison with the drive shaft, a swash plate which is tiltably and rotatably mounted on the drive shaft, the swash plate having a boss and a sliding surface and rotating in unison with the rotary member as the rotary member rotates, a cylinder formed therethrough with a plurality of cylinder bores, a plurality of pistons slidably received in the cylinder bores, respectively, a plurality of shoes each arranged on the sliding surface of the swash plate for relative rotation with respect to the swash plate as the drive shaft rotates, a plurality of connecting rods each of which has one end slidably connected to a corresponding one of the shoes and another end connected to a corresponding one of the pistons, a retainer mounted on the swash plate in a relatively rotatable manner with respect to the swash plate, for retaining the shoes, and a retainer support plate rigidly fitted on the boss of the swash plate, for supporting the retainer in a state held in surface contact with one face of the retainer, wherein an amount of stroke of each of the pistons changes according to an inclination of the swash plate.

The variable capacity swash plate compressor is characterized in that the retainer support plate is formed with a cut-away portion which is cut away therefrom, thereby increasing an exposed area of the one face of the retainer.

According to this variable capacity swash plate compressor, since the retainer support plate is formed with a cut-away portion which is cut away therefrom, thereby increasing an exposed area of the one face of the retainer, lubricant is easily attached to the one face of the retainer, whereby it is possible to reduce abrasion of sliding contact portions of the retainer and the retainer support plate and prevent noises from being produced by the sliding contact portions.

Preferably, the retainer support plate has a generally annular shape, the cut-away portion of the retainer support plate being formed by an arcuate portion cut away from an outer periphery of a compressing piston-side portion of the retainer support plate in a manner such that the compressing piston-side portion of the retainer support plate has a smaller radial width than a radial width of a suctioning piston-side portion of the retainer support plate.

According to the preferred embodiment, in view of the fact that the compressing piston-side portion of the plate does not receive tensile forces from pistons in the suction stroke, the cut-away portion is provided at the outer peripheral portion of the compressing piston-side portion of the retainer support plate. Therefore, it is possible to increase the exposed area of the one face of the retainer while maintaining the required strength of the retainer support plate.

Alternatively, the cut-away portion of the retainer support plate is formed by a plurality of through holes formed through the retainer support plate along a circumference thereof.

According to this preferred embodiment, since the exposed area of the retainer is secured by the through holes formed along the circumference of the retainer support plate, it is also possible to increase the exposed area of the one face of the retainer while maintaining the required strength of the retainer support plate.

More preferably, the through holes of the retainer support plate are formed through a compressing piston-side portion of the retainer support plate.

This preferred embodiment provides the same advantageous effects as described above. Further, it is possible to positively prevent a decrease in strength required of the retainer support plate due to provision of the cut-away portion therefor.

Alternatively, the through holes are formed at equally-spaced intervals through a portion of the retainer support plate along the whole of the circumference thereof.

According to the preferred embodiment, not only the compressing piston-side portion of the retainer support plate but also the suctioning piston-side portion of the same is formed with through holes. Therefore, the exposed area of the one face of the retainer is still increased, and hence lubricant is more easily attached to the one face of the retainer. Further, positioning of the retainer support plate is not required, and hence the retainer support plate can be mounted more easily.

Alternatively, the cut-away portion of the retainer support plate is formed by a portion cut away from a compressing piston-side portion of the retainer support plate in a manner such that the retainer support plate is generally C-shaped in plan view.

According to the preferred embodiment, it is possible to mount the retainer support plate from a direction perpendicular to the drive shaft, and hence the retainer support plate can be mounted more easily, as well.

The above and other objects, features and advantages of the present invention will become more apparent from the following detailed description taken in conjunction with accompanying drawings.

BRIEF DESCRIPTION OF THE DRAWINGS

FIG. 8A is a plan view of a retainer support plate of a variable capacity swash plate compressor according to a third embodiment of the invention;

FIG. 8B is a cross-sectional view taken on line C—C of FIG. 8A;

FIG. 9A is a plan view of a retainer support plate of a variable capacity swash plate compressor according to a fourth embodiment of the invention; and FIG. 9B is a cross-sectional view taken on line D—D of FIG. 9A.

DETAILED DESCRIPTION OF THE PREFERRED EMBODIMENTS

The invention will now be described in detail with reference to drawings showing preferred embodiments thereof.

Figure 4:
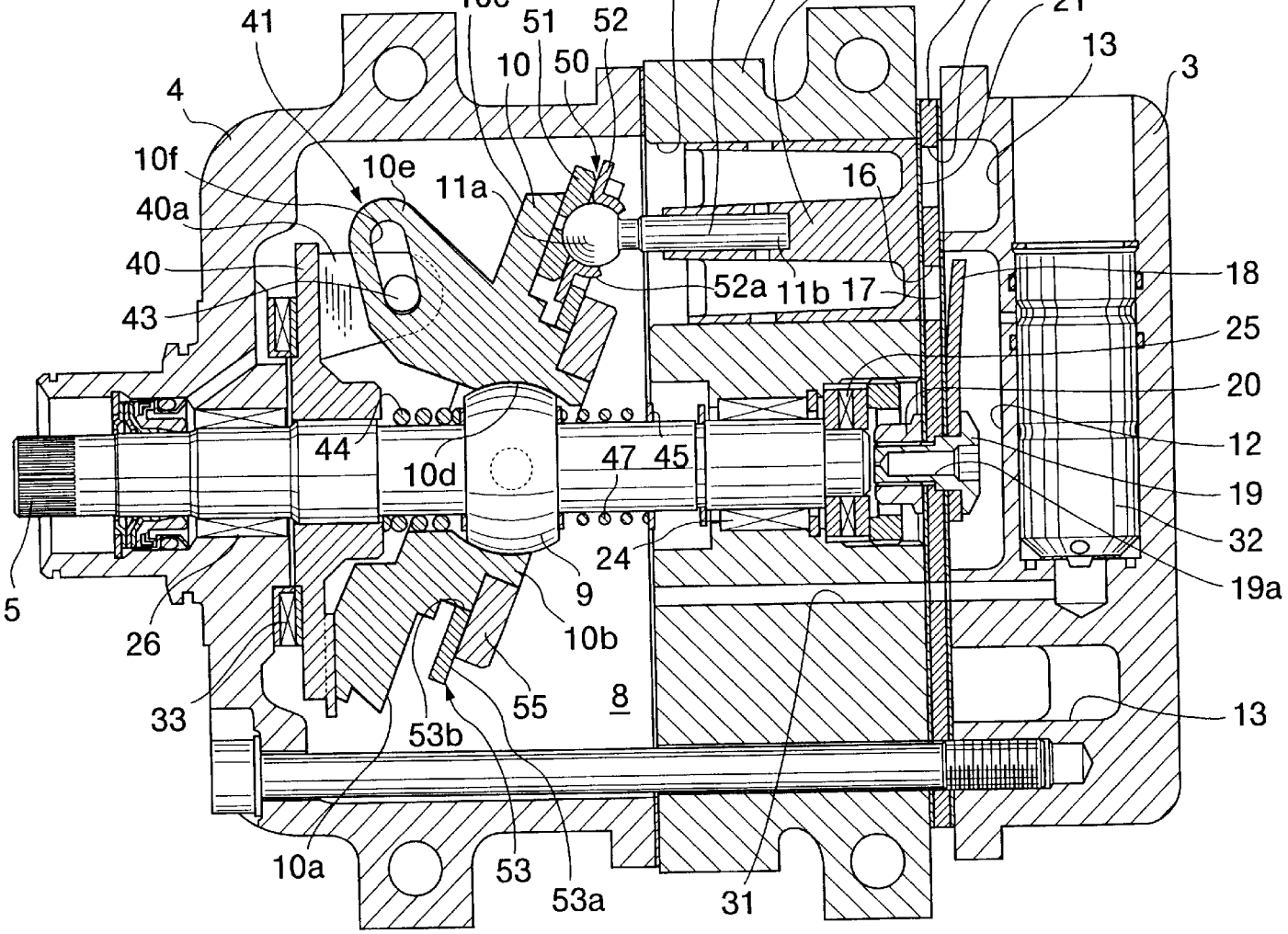
FIG. 4 is a longitudinal cross-sectional view showing the whole arrangement of the variable capacity swash plate compressor according to the first embodiment.
Figure 5:
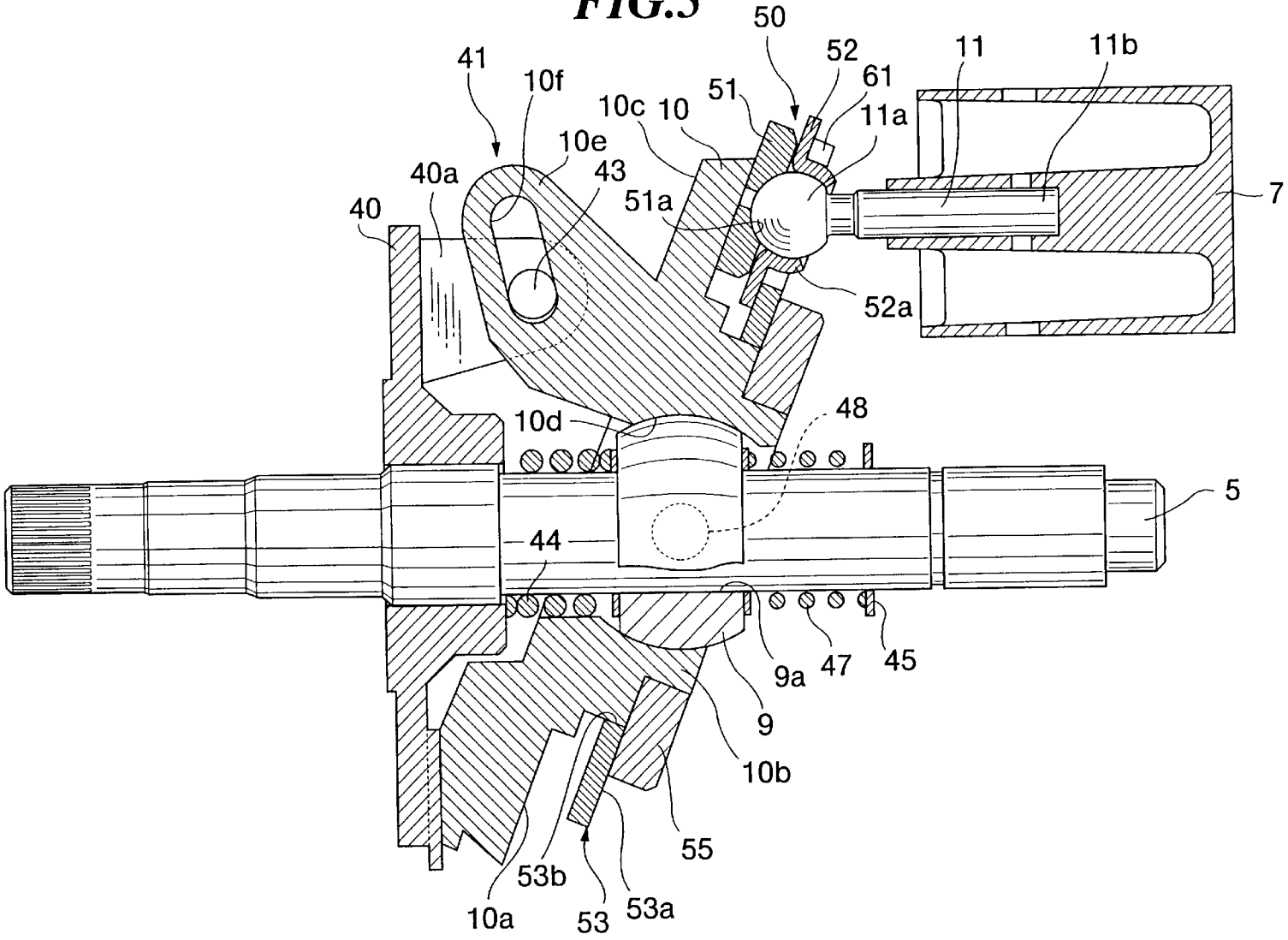
FIG. 5 is an enlarged cross-sectional view showing essential parts of the FIG. 4 variable capacity swash plate compressor.

Referring first to FIG. 4, there is shown the whole arrangement of a variable capacity swash plate compressor according to a first embodiment of the invention. FIG. 5 shows essential parts of the FIG. 4 compressor in cross section, on enlarged scale.

The variable capacity swash plate compressor has a cylinder block 1 having one end thereof secured to a rear head 3 via a valve plate 2 and the other end thereof secured to a front head 4. The cylinder block 1 has a plurality of cylinder bores 6 formed therethrough at predetermined circumferentially-spaced intervals about a drive shaft 5 rotatably extending therethrough. Each cylinder bore 6 has a piston 7 slidably received therein.

Within the front head 4, there is formed a crank case 8. The crank case 8 has a swash plate 10 received therein, which rotates in unison with the drive shaft 5. A shoe 50 to which is connected one end portion, spherical in shape, of a corresponding one of connecting rods 11 in a manner relatively slidable with respect to the shoe 50 is retained on a sliding surface 10*a* of the swash plate 10 by a retainer 53. The retainer 53 is mounted on a boss 10*b* of the swash plate 10 in a manner supported or held by a retainer support plate 55 as described hereinbelow. The connecting rod 11 has the end portion 11*b* thereof secured to the piston 7.

The piston 7 reciprocates within the cylinder bore 6 as the swash plate 10 rotates. The inclination of the swash plate 10 varies with pressure within the crank case 8.

Figure 1:
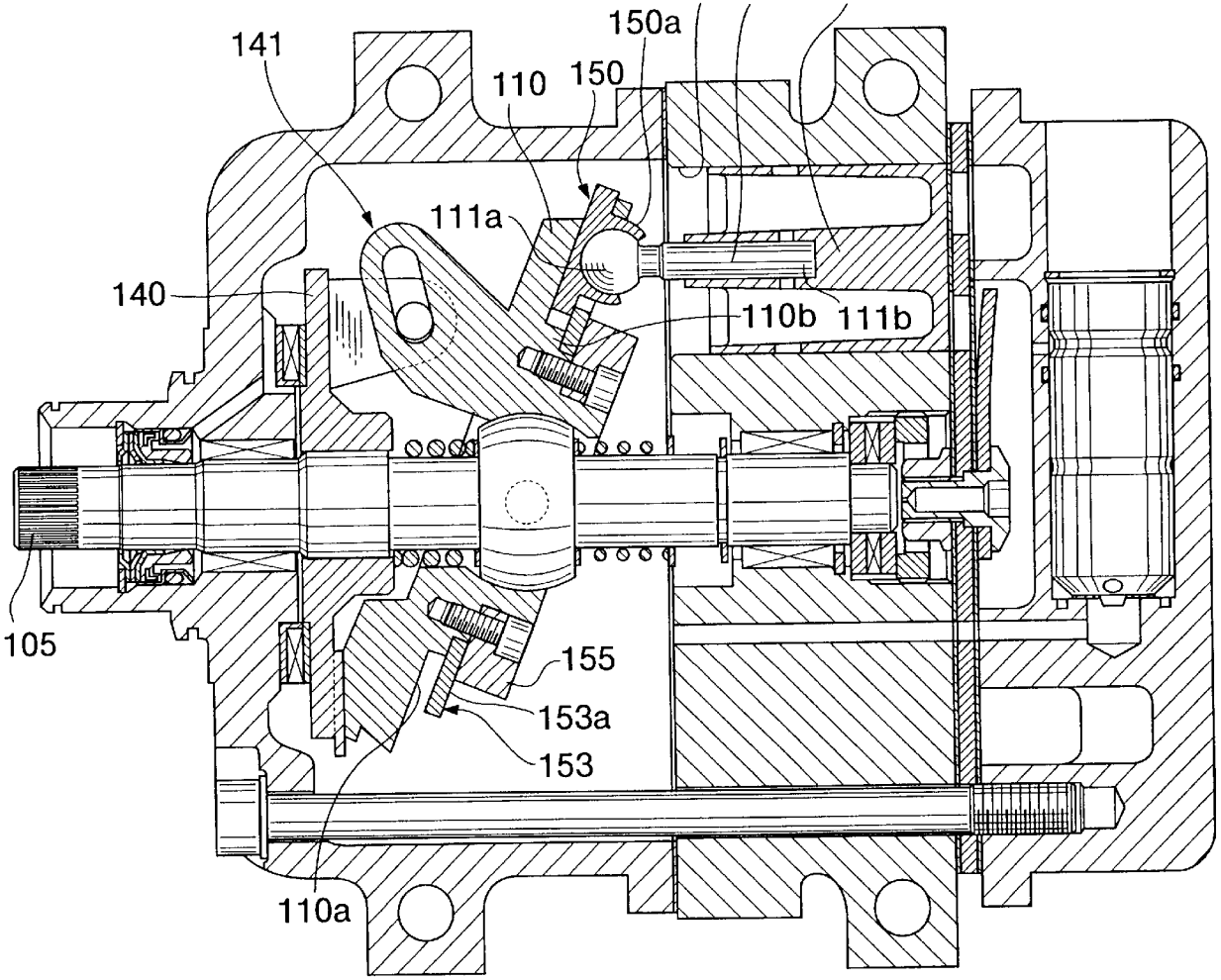
FIG.1 PRIOR ART
FIG. 1 is a longitudinal cross-sectional view showing the whole arrangement of a conventional variable capacity swash plate compressor.
Figure 2:
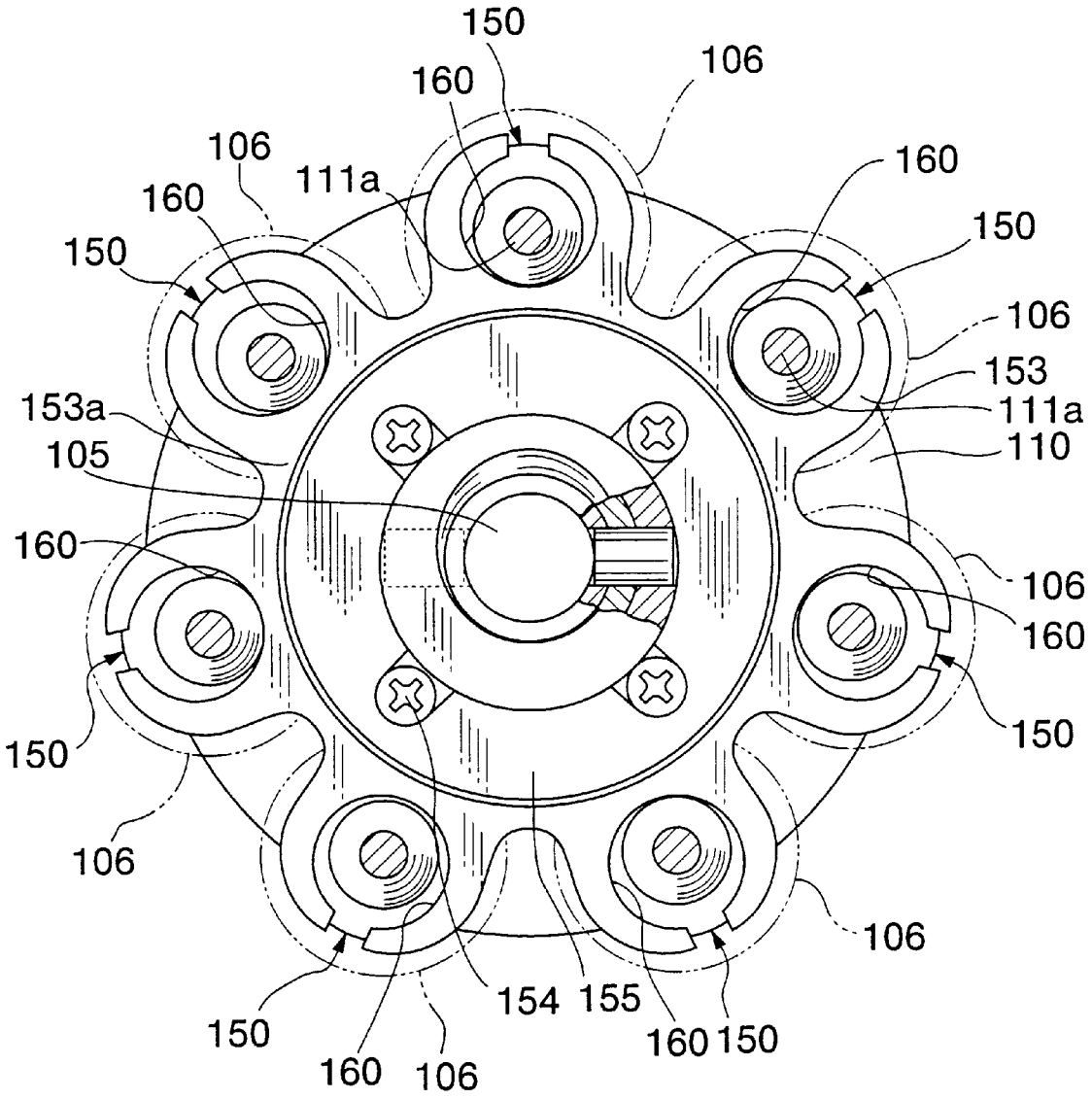
FIG.2 PRIOR ART
FIG. 2 is a view of a swash plate and component parts associated therewith of the FIG. 1 variable capacity swash plate compressor, taken from a rear side of the compressor.
Figure 3:
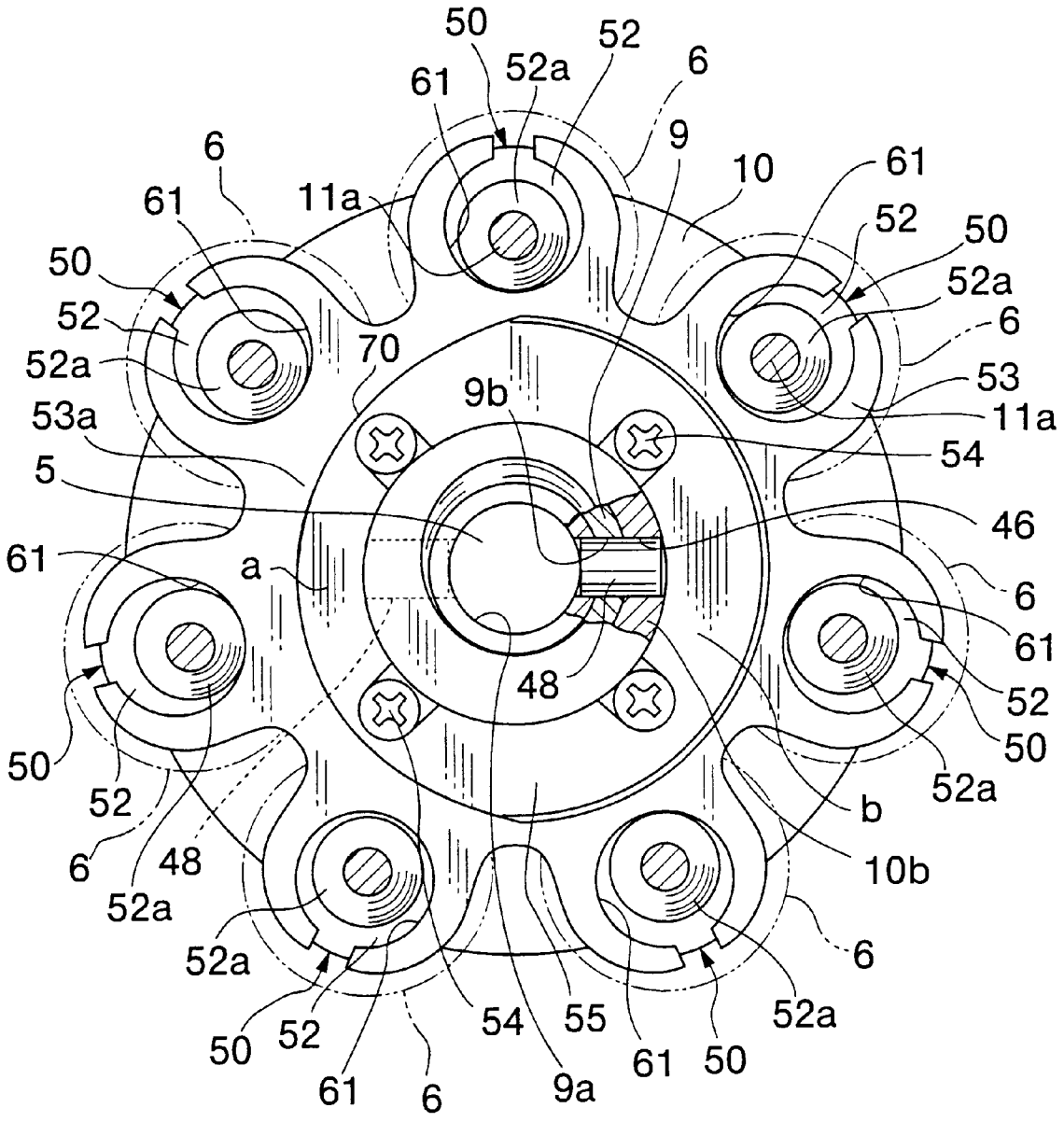
FIG. 3 is a view of a swash plate and component parts associated therewith of a variable capacity swash plate compressor according to a first embodiment of the invention, taken from a rear side of the compressor.
Figures 6A, 6B:
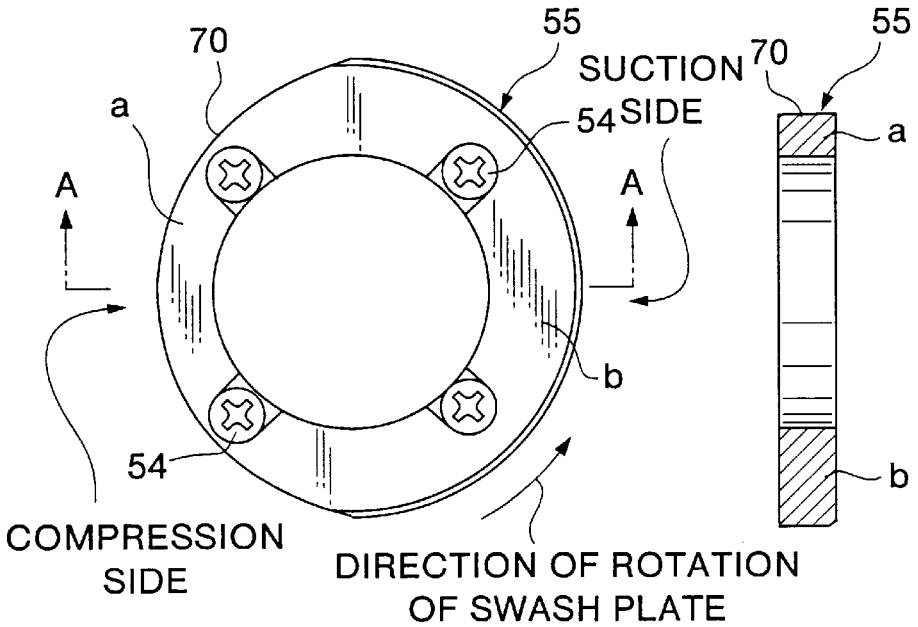
FIG. 6A is a plan view of a retainer support plate appearing in FIG. 5.
FIG. 6B is a cross-sectional view taken on line A—A of FIG. 6A.

FIG. 3 is a view of the swash plate 10 and component parts associated therewith, which is taken from the rear side of the compressor. FIGS. 6A and 6B show the retainer support plate 55 of the variable capacity swash plate compressor according to the first embodiment. FIG. 6A is a plan view of the retainer support plate, while FIG. 6B is a cross-sectional view taken on line A—A of FIG. 6A.

The shoe 50 is comprised of a first support member 51 for slidably supporting a front-side surface of the one spherical end portion 11*a* of the connecting rod 11 such that the one spherical end portion 11*a* of the connecting rod 11 is relatively rotatable with respect to the first support member 51 and a second support member 52 for slidably supporting or retaining a rear-side surface of the one end portion 11*a* of the same such that rear-side surface of the one end portion 11*a* of the same is relatively rotatable with respect to the second support member 52.

The retainer 53 is formed with a central through hole 53*b* in which is fitted a boss 10*b* of the swash plate 10. Further, the retainer 53 has its outer peripheral portion formed with a plurality of broken semi-annular portions 61 along the circumference thereof through each of which a protruding portion 52*a* of the second support member 52 of a corresponding one of the shoes 50 protrudes toward the piston 7. The retainer 53 is supported or held by a retainer support plate 55 which is fixed to the boss 10*b* of the swash plate 10 by bolts 54. The retainer support plate 55 is in surface contact with a central or inner portion of one face 53*a* of the retainer 53. The retainer support plate 55 has its compressing piston-side portion a (substantially left half of the FIG. 6A retainer support plate 55) formed with an arcuate cut-away portion 70 along its periphery. Therefore, the compressing piston-side portion a of the retainer support plate 55 is smaller in area in contact with the retainer 53 than a suctioning piston-side portion b (substantially right half of the FIG. 6A retainer support plate 55) of the same by an area corresponding to the space of the cut-away portion 70.

Within the rear head 3, there are formed a discharge chamber 12 and a suction chamber 13 surrounding the discharge chamber 12.

The valve plate 2 is formed with discharge ports 16 for respectively connecting the cylinder bores 6 with the discharge chamber 12 and suction ports 15 for respectively connecting the cylinder bores 6 with the suction chamber 13. The discharge ports 16 and the suction ports 15 are arranged at predetermined circumferentially-spaced intervals respectively about the drive shaft 5. Each discharge port 16 is opened and closed by a discharge valve 17. The discharge valve 17 is fixed to a rear head-side end face of the valve plate 2 by a bolt 19 and nut 20 together with a valve stopper 18.

On the other hand, each suction port 15 is opened and closed by a suction valve 21 arranged between a front-side end face of the valve plate 2 and the cylinder block 1. The bolt 19 has a guide hole 19*a* for guiding high-pressure refrigerant gas from the discharge chamber 12 to a radial bearing 24 and a thrust bearing 25.

The radial bearing 24 and the thrust bearing 25 are arranged in the cylinder block 1 for rotatably supporting a rear-side end of the drive shaft 5, while a radial bearing 26 is arranged in the front head 4 for rotatably supporting a front-side end of the drive shaft 5.

Further, a communication passage 31 is formed between the suction chamber 13 and the crank case 8. Arranged at an intermediate portion of the communication passage 31 is a pressure control valve 32 for controlling pressure within the suction chamber 13 and the crank case 8.

The drive shaft 5 has a thrust flange 40 rigidly fitted on a front-side portion thereof for transmitting torque of the drive shaft 5 to the swash plate 10. The thrust flange 40 is supported on an inner wall of the front head 4 by a thrust bearing 33. The thrust flange 40 and the swash plate 10 are connected with each other via a linkage 41. The swash plate 10 can tilt with respect to a plane perpendicular to the drive shaft 5. The linkage 41 is comprised of an arm 10*e* formed on a front-side surface 10*c* of the swash plate 10, a pair of projections 40*a* formed on a swash plate-side surface of the thrust flange 40, and a pin 43 which is fixed to the two projections 40*a* and extends therebetween through a slot 10*f* formed through the arm 10*e* interposed between the two projections 40*a*, for engagement with the slot 10*f*.

The swash plate 10 is fitted on the drive shaft 5 via a hinge ball 9 axially slidably mounted on the drive shaft 5.

The hinge ball 9 has a through hole 9*a* through which the drive shaft 5 extends and holes 9*b* extending in a direction perpendicular to the axis of the through hole 9*a* (see FIG. 3). The boss 10*b* of the swash plate 10 has two holes 46 each extending radially such that they are continuous with the holes 9*b* of the hinge ball 9, respectively. Through each associated pair of the hole 9*a* of the hinge ball 9 and the hole 46 of the boss 10*b* extends a cylindrical pin 48. The pins 48 are prevented from falling off by the retainer support plate 55.

The retainer 53 is fitted on an outer peripheral surface of the boss 10*b* of the swash plate 10 and supported or held by the retainer support plate 55.

On the drive shaft 5 is fitted a coiled spring 44 between the hinge ball 9 and the thrust flange 40 to urge the hinge ball 9 toward the cylinder block 1. Further, a coiled spring 47 is mounted on the drive shaft 5 between a stopper 45 fixedly fitted on the drive shaft 5 and the hinge ball 9 to urge the hinge ball 9 toward the thrust flange 40.

Next, the operation of the variable capacity swash plate compressor constructed as above will be described.

When torque of an engine, not shown, installed on an automotive vehicle, not shown, is transmitted to the drive shaft 5 to rotate the same, torque of the drive shaft 5 is transmitted to the swash plate 10 via the thrust flange 40 and the linkage 41 to cause rotation of the swash plate.

The rotation of the swash plate 10 causes relative rotation of the shoe 50 on the sliding surface 10*a* of the swash plate 10 with respect to the swash plate 10, whereby the torque transmitted from the swash plate 10 is converted into reciprocation of the piston 7. As the piston 7 reciprocates within the cylinder bore 6, the volume of space or compression chamber within the cylinder bore 6 changes. As a result, suction, compression and delivery of refrigerant gas are sequentially carried out in each compression chamber, whereby high-pressure refrigerant gas is discharged from the compression chamber in an amount corresponding to an inclination of the swash plate 10. During the suction stroke, the suction valve 21 opens to draw low-pressure refrigerant gas from the suction chamber 13 into the compression chamber within the cylinder bore 6. During the discharge stroke, the discharge valve 17 opens to deliver the high-pressure refrigerant gas from the compression chamber into the discharge chamber 12.

When thermal load on the compressor decreases, the pressure control valve 32 closes the communication passage 31, whereby pressure within the crank case 8 is increased, so that the inclination of the swash plate 10 becomes smaller. As a result, the stroke of the piston 7 is decreased to reduce delivery quantity or capacity of the compressor.

On the other hand, when the thermal load on the compressor increases, the pressure control valve 32 opens the communication passage 31, whereby the pressure within the crank case 8 is lowered, so that the inclination of the swash plate 10 becomes larger. As a result, the stroke of the piston 7 is increased to increase the delivery quantity or capacity of the compressor.

Further, since the retainer support plate 55 has its compressing piston-side portion a formed with the cut-away portion 70 such that the retainer support plate 55 has a reduced contact area brought into contact with the retainer 53, the retainer 53 has an increased exposed area, which enables a larger amount of lubricant contained in refrigerant gas to be attached to the retainer 53.

According to the variable capacity swash plate compressor of the first embodiment, the exposed area of the retainer 53 is increased whereby a larger amount of lubricant contained in refrigerant gas is attached to the retainer 53 as described above, so that the sliding contact portions of the retainer 53 and the retainer support plate 55 brought into sliding contact with each other are positively lubricated. This makes it possible to reduce abrasion of the sliding contact portions, and prevent noises from being produced by the sliding contact portions.

Figures 7A, 7B:
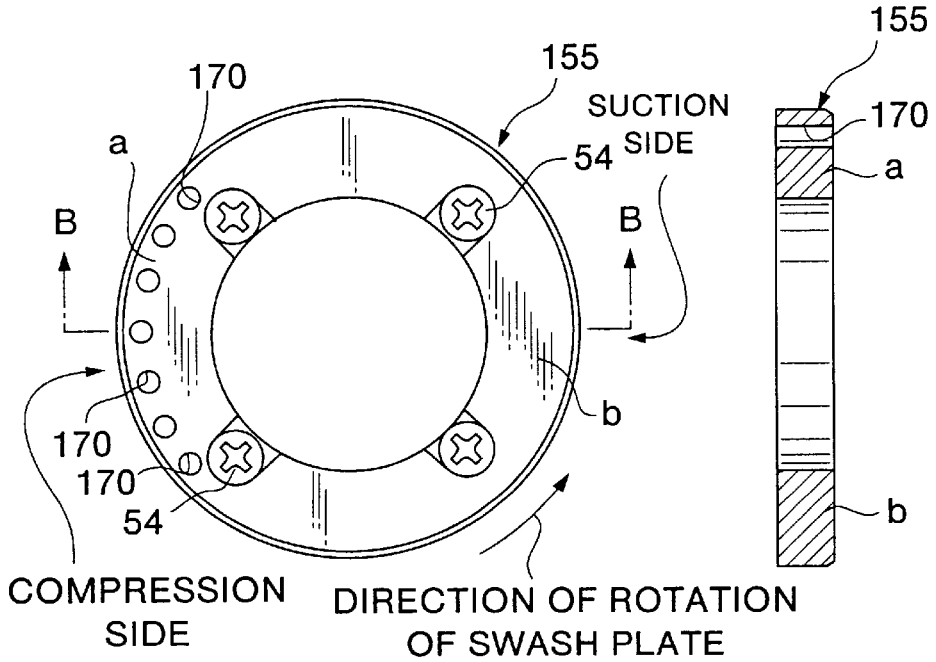
FIG. 7A is a plan view of a retainer support plate of a variable capacity swash plate compressor according to a second embodiment of the invention.
FIG. 7B is a cross-sectional view taken on line B—B of FIG. 7A.

FIGS. 7A and 7B show a retainer support plate of a variable capacity swash plate compressor according to a second embodiment of the invention. FIG. 7A is a plan view of the retainer support plate, while FIG. 7B is a cross-sectional view of the same taken on line B—B of FIG. 7A. Component parts and elements corresponding to those of the first embodiment are indicated by identical reference numerals, and description thereof is omitted.

This embodiment is distinguished from the first embodiment, in which the retainer support plate 55 has its compressing piston-side portion a formed with the arcuate cut-away portion 70, in that, as shown in FIG. 7A, the retainer support plate 155 has its compressing piston-side portion a formed therethrough with a plurality of round through holes 170 along part of the circumference thereof.

The variable capacity swash plate compressor according to the second embodiment provides the same effects as obtained by the compressor of the first embodiment. Further, the compressor is capable of preventing decrease in strength of the retainer support plate 155 which is ascribable to an increase of an exposed area of the retainer 53.

FIGS. 8A and 8B show a retainer support plate of a variable capacity swash plate compressor according to a third embodiment of the invention. FIG. BA is a plan view of the retainer support plate, while FIG. 8B is a cross-sectional view of the same taken on line C—C of FIG. 8A. Component parts and elements corresponding to those of the above embodiments are indicated by identical reference numerals, and description thereof is omitted.

This embodiment is distinguished from the second embodiment, in which the retainer support plate 155 has its compressing piston-side portion a formed with the plurality of round through holes 170, in that, as shown in FIG. 8A, the retainer support plate 255 has a plurality of round through holes 270 formed therethrough at equally-spaced intervals along the whole circumference thereof.

The variable capacity swash plate compressor according to the third embodiment provides the same effects as obtained by the compressor of the second embodiment. (The diameter of each round through hole 170 can be suitably determined.) Further, positioning of the retainer support plate 255 is not required during assembly, which permits easier mounting of the same.

FIGS. 9A and 9B show a retainer support plate of a variable capacity swash plate compressor according to a fourth embodiment of the invention. FIG. 9A is a plan view of the retainer support plate, while FIG. 9B is a cross-sectional view of the same taken on line D—D of FIG. 9A. Component parts and elements corresponding to those of the first embodiment are indicated by identical reference numerals, and description thereof is omitted.

In this embodiment, as shown in FIG. 9A, the retainer support plate 355 has a portion of its compressing piston-side portion a cut away or removed such that the retainer support plate 355 is generally C-shaped in plan view.

The variable capacity swash plate compressor according to the fourth embodiment provides the same effects as obtained by the compressor of the second embodiment. Further, it is possible to mount the retainer support plate 355 from a direction perpendicular to the drive shaft 5.

It is further understood by those skilled in the art that the foregoing is the preferred embodiments of the invention, and that various changes and modification may be made without departing from the spirit and scope thereof.

What is claimed is:

1. In a variable capacity swash plate compressor including a drive shaft, a rotary member fixedly fitted on said drive shaft, for rotation in unison with said drive shaft, a swash plate which is tiltably and rotatably mounted on said drive shaft, said swash plate having a boss and a sliding surface and rotating in unison with said rotary member as said rotary member rotates, a cylinder formed therethrough with a plurality of cylinder bores, a plurality of pistons slidably received in said cylinder bores, respectively, a plurality of shoes each arranged on said sliding surface of said swash plate for relative rotation with respect to said swash plate as said drive shaft rotates, a plurality of connecting rods each of which has one end slidably connected to a corresponding one of said shoes and another end connected to a corresponding one of said pistons, a retainer mounted on said swash plate in a relatively rotatable manner with respect to said swash plate, for retaining said shoes, and a retainer support plate rigidly fitted on said boss of said swash plate, for supporting said retainer in a state held in surface contact with one face of said retainer, wherein an amount of stroke of each of said pistons changes according to an inclination of said swash plate, the improvement wherein said retainer support plate is formed with a cut-away portion which is cut away therefrom, thereby increasing an exposed area of said one face of said retainer.

2. A variable capacity swash plate compressor according to claim 1, wherein said retainer support plate has a generally annular shape, said cut-away portion of said retainer support plate being formed by an arcuate portion cut away from an outer periphery of a compressing piston-side portion of said retainer support plate in a manner such that said compressing piston-side portion of said retainer support plate has a smaller radial width than a radial width of a suctioning piston-side portion of said retainer support plate.

3. A variable capacity swash plate compressor according to claim 1, wherein said cut-away portion of said retainer support plate is formed by a plurality of through holes formed through said retainer support plate along a circumference thereof.

4. A variable capacity swash plate compressor according to claim 3, wherein said through holes of said retainer support plate are formed through a compressing piston-side portion of said retainer support plate.

5. A variable capacity swash plate compressor according to claim 3, wherein said through holes are formed at equally-spaced intervals through a portion of said retainer support plate along the whole of said circumference thereof.

6. A variable capacity swash plate compressor according to claim 1, wherein said cut-away portion of said retainer support plate is formed by a portion cut away from a compressing piston-side portion of said retainer support plate in a manner such that said retainer support plate is generally C-shaped in plan view.

* * * * *